United States Patent [19]

Shabel et al.

[11] Patent Number: 4,737,198

[45] Date of Patent: Apr. 12, 1988

[54] METHOD OF MAKING ALUMINUM FOIL OR FIN SHOCK ALLOY PRODUCT

[75] Inventors: Barrie S. Shabel, Franklin Township, Westmoreland County; Stephen F. Baumann, Forest Hills; Robert E. Sanders, Jr., New Kensington, all of Pa.

[73] Assignee: Aluminum Company of America, Pittsburgh, Pa.

[21] Appl. No.: 838,773

[22] Filed: Mar. 12, 1986

[51] Int. Cl.[4] ..... C22F 1/04

[52] U.S. Cl. ..... 148/2; 148/11.5 A; 148/437; 428/606

[58] Field of Search ..... 148/11.5 A, 2, 437–440; 428/606

[56] References Cited

U.S. PATENT DOCUMENTS

| | | | |
|---|---|---|---|
| 3,397,444 | 8/1968 | Bergmann et al. | 29/470.1 |
| 3,989,548 | 11/1976 | Morris | 148/2 |
| 4,126,487 | 11/1978 | Morris et al. | 148/2 |
| 4,334,935 | 6/1982 | Morris | 148/2 |

OTHER PUBLICATIONS

Nes, E. et al., "Casting and Annealing Structures in Strip Cast Aluminum Alloys", *Aluminum*, 55 Jahrg., 1979, 5, pp. 319–324.

*Primary Examiner*—L. Dewayne Rutledge
*Assistant Examiner*—Robert L. McDowell
*Attorney, Agent, or Firm*—Douglas G. Glantz

[57] ABSTRACT

The present invention includes casting, e.g., such as by roll casting, or slab casting, an alloy having components in the composition range of about 0.5–1.2% iron, 0.7–1.3% manganese, and 0–0.5% silicon by weight, homogenizing the cast alloy at temperatures below about 1100° F., preferably below about 1050° F. to control the microstructure, and cold rolling to a final product gauge. Such a final product gauge for fin stock applications include thickness in the range of about 0.003–0.006 inch. The cold rolled alloy is then partially annealed to attain desired levels of strength and formability.

18 Claims, 1 Drawing Sheet

PARTIAL ANNEALING CURVES FOR NEW ALLOY VS. 3003

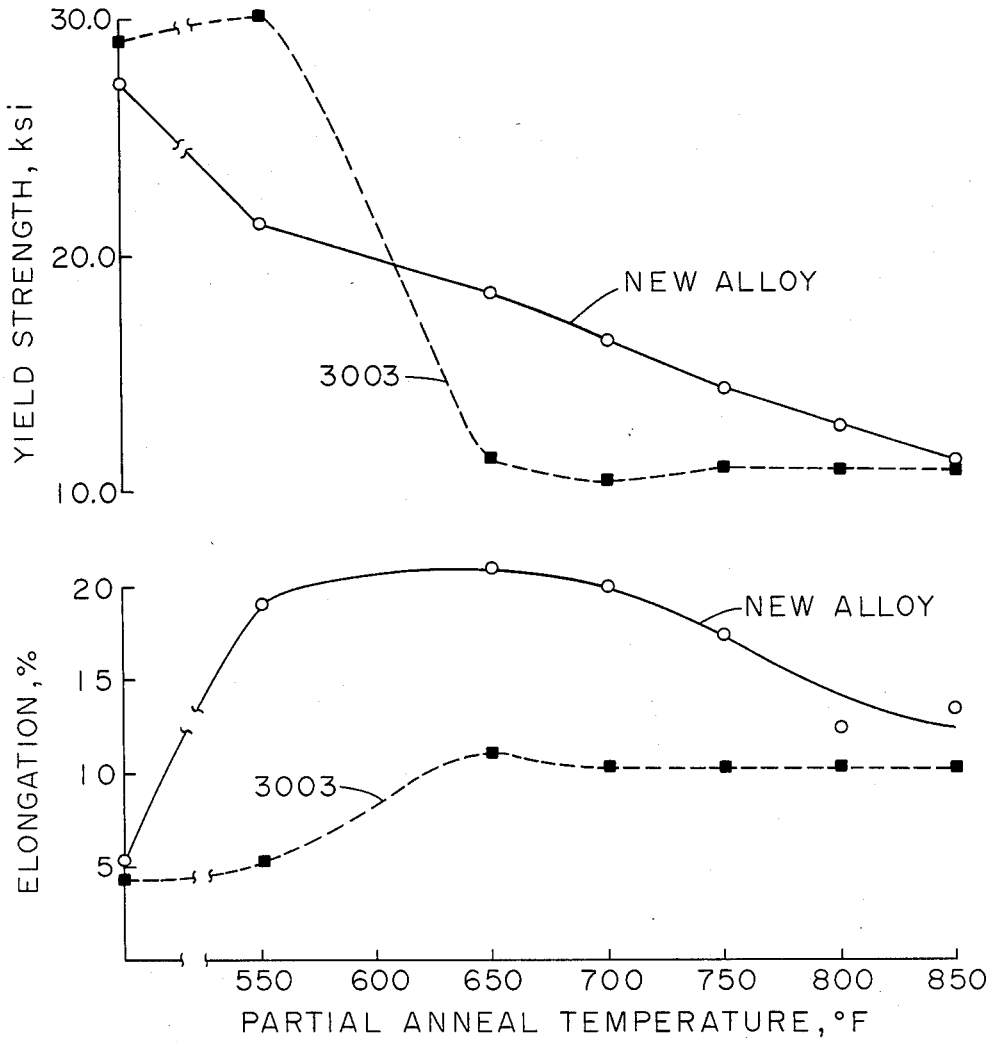
PARTIAL ANNEALING CURVES
FOR NEW ALLOY VS. 3003

METHOD OF MAKING ALUMINUM FOIL OR FIN SHOCK ALLOY PRODUCT

BACKGROUND OF THE INVENTION

The present invention relates to a process for producing foil or fin stock type material from aluminum alloy.

Generic aluminum alloys for producing foil or fin stock are well known. Such generic alloys are represented by 1100, 7072, or 3003. An alloy similar to 3003 (1.0% Fe, 1.2% Mn) containing about 1% zinc for improved corrosion resistance was developed at Alcoa Laboratories of Aluminum Company of America several years ago. However, this alloy still requires a high preheat temperature on the order of about 1100° F. for optimum formability. This alloy recrystallized readily at temperatures below about 700° F. but produced an alloy having a yield strength only on the order of about 6 ksi.

It has been proposed in U.S. Pat. No. 3,397,444 to produce aluminum foil in light gauge aluminum can stock by rolling aluminum alloys containing 0.6–2.5% iron as the essential alloying element, although small amounts of alloying elements, notably magnesium, manganese, and silicon may be present. The essential alloy is cast in conventional ingot form and is reduced to its final gauge by successive hot rolling and cold rolling operations.

U.S. Pat. No. 3,989,548 discloses a procedure for producing high strength aluminum sheet in which a eutectic or near-eutectic ternary aluminum alloy, such as 8007, is cast under controlled conditions so that the intermetallic phases form into thin rods having a length many times greater than their cross section.

It is an object of the present invention to provide a process for producing a foil or fin stock type material having high levels of strength and formability.

It is a further object of the present invention to provide a light gauge sheet, e.g., approximately 0.003–0.006 inch thick sheet, having high strength and formability.

It is yet another object of the present invention to provide an aluminum alloy material having a yield strength higher than annealed ingot source alloys.

It is another object of the present invention to provide a composition which will avoid coarse primary constituents which can occur in 8007 alloy and degrade formability.

It is yet another object of the present invention to provide a material having a uniform structure which has good appearance and avoids localized coarse grains which degrade performance.

SUMMARY OF THE INVENTION

The present invention includes casting, e.g., such as by roll casting, or slab casting, an alloy having components in the composition range of about 0.5–1.2% iron, 0.7–1.3% manganese, and 0–0.5% silicon by weight, homogenizing the cast alloy at temperatures below about 1100° F., preferably below about 1050° F. to control the microstructure, and cold rolling to a final product gauge. Such a final product gauge for fin stock applications include thickness in the range of about 0.003–0.006 inch. The cold rolled alloy is then partially annealed to attain desired levels of strength and formability.

BRIEF DESCRIPTION OF THE DRAWING

The Figure depicts a comparison of yield strength and elongation for alloy 3003 and the alloy of the present invention.

DETAILED DESCRIPTION

The process of the present invention is unique in its combination of processing, including roll casting of slab casting, and alloying, including specifying iron, manganese, and silicon amounts in the composition, to produce a foil or fin stock type material having unexpectedly high levels of strength and formability.

The present invention includes roll casting or slab casting an Al-Mn-Fe-Si-Zn alloy and fabricating the alloy to light gauge sheet or foil, e.g., sheet having approximately 0.003–0.006 inch thickness, followed by controlled partial annealing to achieve combinations of strength and formability not achieved by conventional techniques.

By roll casting or slab casting a plate or sheet less than ¾ inch thick of the specified alloy and controlling the morphology of the Al-Fe-Mn constituents, a material has been produced which does not recrystallize fully even at temperatures of about 850° F., yet has more than twice the yield strength at approximate levels of formability as the annealed ingot source material. Further, this combined composition/processing route yields a material having properties which are, surprisingly, equivalent or superior to 8007 alloy containing higher levels of total iron plus manganese than the alloy of this invention.

The composition range for the alloy in accordance with the present invention is shown below.

TABLE I

| | Wt % |
|---|---|
| Elements | |
| Fe | 0.5 to 1.20 |
| Mn | 0.7 to 1.30 |
| Si | 0.0 to 0.50 |
| Cu | 0.0 to 0.20 |
| Zn | 0.7 to 2.00 |
| Impurities | |
| Mg | (0.05 max) |
| Ti | (0.15 max) |

The specified alloy is cast and homogenized at temperatures below about 1100° F., preferably below about 1050° F. The thermal treatment controls the microstructure by minimizing Mn in solution and maximizing dispersoid size without recrystallization. The alloy is then cold rolled to the final product gauge. For fin stock applications, the final product gauge is in the range of about 0.003–0.006 inch. Partial annealing is then employed to optimize strength and formability. An example of the combined strength and formability that can be achieved for an annealing temperature of 750° F. with a two-hour soak is shown in Table II.

TABLE II

| | |
|---|---|
| YS (ksi) | 15–16 |
| TS (ksi) | 20–21 |
| % El. (2" G.L.) | 30–32 |
| Ball Punch Deformation Test (in.) ("Olsen" - with oil/PE lubricant) | .344 |

The process of the present invention has been found to develop a fine grained, high strength fin stock alloy with good formability for flaring and tube forming operations. The grain size is partly recrystallized and has a uniform structural appearance. The alloy is particularly useful in producing light gauge sheet or foil for fin stock or foil for packaging applications.

The preheat treatment in the process of the present invention has the critical function of precipitating solute, primarily manganese, from solution and establishing the proper particle distribution. The preheat treatment must be performed at low enough temperatures such that the sheet does not recrystallize. Otherwise, the sheet experiences recrystallization and develops a very large grain size. Above the specified recrystallization temperature, the sheet begins to recrystallize at the sheet surface. At even higher preheat temperatures, the entire sheet will recrystallize, and these large grains are present in the material even after subsequent cold rolling to final foil gauge. Although elongated in the rolling direction, the large grain size still retains its definition to some extent. Further, when the material is partially annealed to bring the strength down and the formability up to its useful level, these large grains become more sharply defined and, during deformation, cause unusual distortions of the foil. If only the sheet surface recrystallized during the previous cycle, the properties of the foil can still be acceptable, but the large surface grains can induce distortion of the deformed foil and are objectionable for cosmetic reasons.

An alloy having a specified composition in accordance with the present invention has produced therein a surface recrystallization during a preheat of about 950° F. for about four hours but not at about 875° F. for eight hours. The material that recrystallizes during the preheat loses strength at a lower temperature than the material which does not recrystallize during the preheat but still allows for a good combination of strength, elongation, and formability. However, the recrystallized material shows visible distortions to deformed tensile samples and visible grain structures in the Olsen test for all partial and annealed conditions. This is deemed objectionable for cosmetic reasons, but more particularly, it is very difficult to control to the extent of recrystallization formation during preheat and thereby is not desirable in forming a metallurgical material.

The specified alloy composition according to the present invention has been cast on a laboratory roll caster and preheated for four hours at about 850° F. and has produced yield strengths on the order of about 14–18 ksi. In contrast, a commercial roll cast alloy 3003 preheated below the respective recrystallization temperatures, i.e., at about four hours at about 850° F. produces a very rapid drop in the strength with annealing temperature. As shown in the Figure, the yield strength YS of 3003 drops sharply on partial annealing at 500°–600° F. The alloy of this invention shows a more gradual change in YS with partial annealing temperature. At the same time, the elongation and formability of our alloy is markedly increased while the elongation of 3003 changes only slightly. This response produces a significant advantage in forming characteristics of our alloy. The 3003 alloy processed through this preheat treatment leaves too much manganese in solution and yields an inappropriate particle distribution. The undesired particle distribution is attributable to high manganese and silicon levels which could require that the alloy have a much longer time in the preheat temperature to achieve an appropriate particle distribution. The commercial 3003 composition also has a relatively high maximum permissible copper content. Although partially annealed mechanical properties might not be significantly changed by copper amounts up to about 0.26% by weight, copper shifts the solution potential of the material such that the corrosion resistance of the alloy is adversely affected. For these reasons, a commercial 3003 alloy composition processed in accordance with the present invention produces an undesirable microstructure.

A more preferred range of composition of alloy process in accordance with the present invention is shown in Table III.

TABLE III

| | Wt % |
|---|---|
| Elements | |
| Mn | 0.70 to 1.00 |
| Fe | 0.80 to 1.20 |
| Zn | 0.85 to 1.30 |
| Cu | 0.00 to 0.10 |
| Si | 0.05 to 0.25 |
| Impurities | |
| Mg | (0.02 max) |
| Ti | (0.06 max) |

At less than about 1.5% manganese plus iron, strength and formability control decreases. At manganese plus iron amounts above about 2.5% by weight, coarse constituents will form and formability will decrease.

At silicon contents of greater than about 0.2% by weight, proper control of dispersoid distribution is difficult and recrystallization is uncontrolled.

The zinc and copper contents in the alloy of the present invention provide corrosion control. Above about 0.2% by weight copper, corrosion resistance is lowered. The range of zinc specified for the alloy is known to benefit corrosion resistance in fin stock applications.

The homogenization temperature preferably is controlled in the range of about 850°–1050° F. for a period of about 2–24 hours and more preferably in the range of about 850°–950° F. for about 2–12 hours.

While the invention has been described in terms of preferred embodiments, the claims appended hereto are intended to encompass all embodiments which fall within the spirit of the invention.

What is claimed is:

1. A process for producing light gauge sheet having high levels of strength and formability, comprising:

(a) roll casting or slab casting an aluminum alloy containing about 0.5–1.2 wt. % iron, 0.7–1.3 wt. % manganese, and 0–0.50 wt. % silicon to form a cast sheet having controlled particle size distribution;

(b) preheating the roll cast sheet at controlled temperature and time;

(c) cold rolling the sheet to a final product gauge of less than about 0.25 inch thickness; and (d) annealing to increase strength and formability.

2. A process as set forth in claim 1 wherein said preheat temperature is less than about 1100° F.

3. A process as set forth in claim 2 wherein said preheat temperature and time fall in the range of 850°–1050° F. for periods of 2–24 hours.

4. A process as set forth in claim 3 wherein said preheat temperature and time fall in the range of 850°–950° F. for periods of 2–12 hours.

5. A process as set forth in claim 4 wherein said light gauge sheet comprises foil or fin stock.

6. A process as set forth in claim 5 comprising cold rolling to a final product thickness in the range of 0.003–0.006 inch.

7. A light gauge sheet having high strength and formability formed by the process according to claim 1.

8. A foil or fin stock formed by the process according to claim 1.

9. An aluminum alloy product containing about 0.5–1.2 wt. % iron, 0.7–1.3 wt. % manganese, and 0–0.50 wt. % silicon by the process according to claim 1.

10. A process for producing light gauge sheet having high levels of strength and formability, comprising:

(a) roll casting or slab casting an aluminum alloy containing about 0.80–1.20 wt. % iron, 0.70–1.00 wt. % manganese, and 0.05–0.25 wt. % silicon to form a cast sheet having controlled particle size distribution;

(b) preheating the roll cast sheet at controlled temperature and time;

(c) cold rolling the sheet to a final product gauge of less than about 0.25 inch thickness; and (d) annealing to increase strength and formability.

11. A process as set forth in claim 10 wherein said preheat temperature is less than about 1100° F.

12. A process as set forth in claim 11 wherein said preheat temperature and time fall in the range of 850°–1050° F. for periods of 2–24 hours.

13. A process as set forth in claim 12 wherein said preheat temperature and time fall in the range of 850°–950° F. for periods of 2–12 hours.

14. A process as set forth in claim 13 wherein said light gauge sheet comprises foil or fin stock.

15. A process as set forth in claim 14 comprising cold rolling to a final product thickness in the range of 0.003–0.006 inch.

16. A light gauge sheet having high strength and formability formed by the process according to claim 10.

17. A foil or fin stock formed by the process according to claim 10.

18. An aluminum alloy product containing about 0.80–1.20 wt. % iron, 0.70–1.00 wt. % manganese, and 0.05–0.25 wt. % silicon formed by the process according to claim 10.

* * * * *

UNITED STATES PATENT AND TRADEMARK OFFICE

CERTIFICATE OF CORRECTION

PATENT NO. : 4,737,198

DATED : April 12, 1988

INVENTOR(S) : Barrie S. Shabel et al

It is certified that error appears in the above-identified patent and that said Letters Patent is hereby corrected as shown below:

On the Title page, and in Column 1, line 2, in the Title, change "Shock" to "Stock".

Signed and Sealed this

Twentieth Day of September, 1988

*Attest:*

DONALD J. QUIGG

*Attesting Officer*

*Commissioner of Patents and Trademarks*